US005857792A

United States Patent [19]

Iffinger

[11] Patent Number: 5,857,792

[45] Date of Patent: Jan. 12, 1999

[54] APPARATUS FOR A BAR OF SOAP AND ATTACHED SPONGE

[76] Inventor: Gregg M. Iffinger, 5656 Kingsmill Dr., Bloomfield Hills, Mich. 48301

[21] Appl. No.: 955,977

[22] Filed: Oct. 22, 1997

[51] Int. Cl.[6] ..... C11D 17/00

[52] U.S. Cl. ..... 401/19; 401/88

[58] Field of Search ..... 401/19, 88

[56] References Cited

U.S. PATENT DOCUMENTS

| | | | |
|---|---|---|---|
| 1,027,208 | 5/1912 | Manheim | 401/88 |
| 2,946,074 | 7/1960 | Caldwell | 401/19 |
| 3,293,684 | 12/1966 | Tundermann | 401/19 X |
| 3,498,726 | 3/1970 | Schwartz | 401/19 |
| 4,050,825 | 9/1977 | Stein | 401/19 |
| 4,190,550 | 2/1980 | Campbell . | |
| 4,203,857 | 5/1980 | Dugan | 401/19 X |
| 4,335,007 | 6/1982 | Owens | 401/88 X |
| 4,457,640 | 7/1984 | Anderson . | |
| 4,621,934 | 11/1986 | Starek | 401/19 |
| 4,789,262 | 12/1988 | Sanchez . | |
| 4,969,225 | 11/1990 | Schubert . | |
| 5,031,759 | 7/1991 | Ogilvie . | |
| 5,366,125 | 11/1994 | Procido . | |

FOREIGN PATENT DOCUMENTS

| | | | |
|---|---|---|---|
| 712504 | 7/1931 | France | 401/88 |
| 1074798 | 2/1960 | Germany | 401/19 |

*Primary Examiner*—Steven A. Bratlie
*Attorney, Agent, or Firm*—Harness, Dickey & Pierce, P.L.C.

[57] ABSTRACT

A bar of soap in combination with a sponge for use in washing a persons body. The bar of soap is either adhesively bonded to the sponge or may be mechanically bonded to a plate or substrate which is in turn adhesively bonded to the sponge.

7 Claims, 2 Drawing Sheets

APPARATUS FOR A BAR OF SOAP AND ATTACHED SPONGE

BACKGROUND OF THE INVENTION

1. Technical Field

This invention relates generally to a bar of soap and an attached cleaning pad or sponge and, more particularly, to a bar of soap attached to a sponge so that a user may conveniently have both the soap and the sponge at their disposal simultaneously.

2. Discussion

It has long been known and desirable to provide a cleaning pad, cloth, or sponge in combination with soap or other cleaning material so that the user has both the soap and the cleaning pad or sponge ready for use. Most attempts at such a combination, however, have not been successful for either economical, functional, or aesthetic reasons. Despite past attempts which have been less than fully successful, the need persists for a bar of soap in combination with a sponge which proves to be both economical, functionally acceptable, and aesthetic acceptable.

Thus, it is an object of the present invention to provide a bar of soap in combination with a sponge so that the bar of soap and the sponge are formed as a unitary component to facilitate their use.

SUMMARY OF THE INVENTION

This invention is directed to a bar of soap in combination with a sponge. A substantially solid block of soap attaches to a sponge to form a unitary construction of the soap and the sponge. The soap and sponge may be attached by an adhesive layer. Alternatively, the soap and sponge may be attached through a plate or substrate interposed between the sponge and the soap. The plate attaches to the soap through fingers which project into the soap, and the plate attaches to the sponge through an adhesive layer.

From the subsequent detailed description taken in conjunction with the accompanying drawings and subjoined claims, other objects and advantages of the present invention will become apparent to those skilled in the art.

BRIEF DESCRIPTION OF THE DRAWINGS

The various advantages of the present invention will become apparent to one skilled in the art by reading the following specification and by reference to the following drawings in which.

DETAILED DESCRIPTION OF THE PREFERRED EMBODIMENTS

Figure 1:
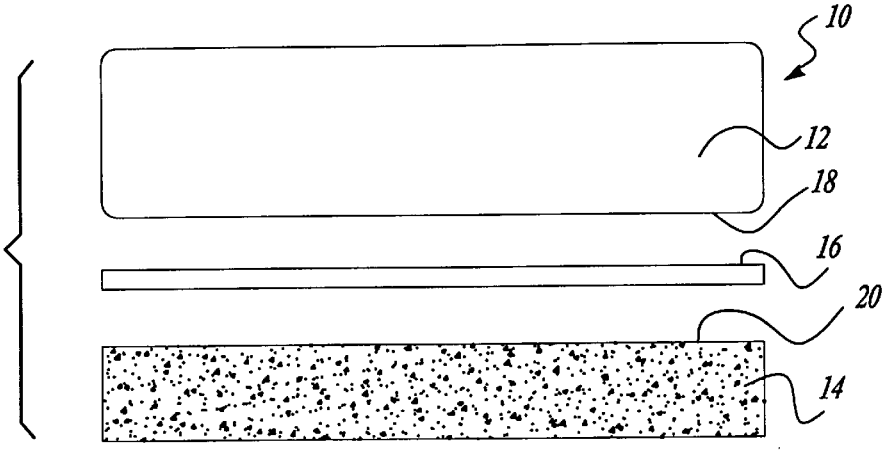
FIG. 1 is an exploded view of a bar of soap in combination with a sponge in accordance with the principles of a first embodiment of the present invention.
Figure 2:
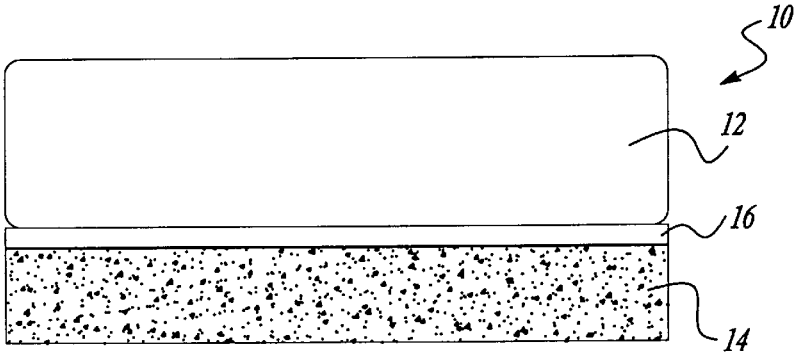
FIG. 2 is a elevational view of the bar or soap in combination with the sponge of FIG. 1, with the soap and sponge being shown in close proximity.

With reference to FIGS. 1 and 2, the combination soap and sponge 10 is shown as arranged in accordance with the principles of a first embodiment of the present invention. The soap and sponge combination 10 comprises a generally solid bar of soap 12 as is commonly known to those skilled in the art. The bar of soap 12 attaches to a sponge 14 to form the combination soap and sponge 10. The bar of soap 12 and sponge 14 are bonded by an adhesive layer 16 interposed between the bar of soap 12 and the sponge 14. The bar of soap 12 adheres to adhesive layer 16 on a first side 18. Similarly, the sponge 14 adheres to the adhesive layer 16 on a first side 20. In this manner, the bar of soap 12 and sponge 14 provide a unitary component for convenient, simultaneous handling by a user. In the present embodiment, because the bar of soap 12 is solid and has substantial rigidity, the bar of soap 12 provides rigidity, through the adhesive layer 16, to the sponge 14 as well. This enables the user to wring out the sponge 14 by compression towards bar of soap 12 and also assists in maintaining the shape of the sponge 14 substantially flat in accordance with the shape of the bar of soap 12.

Figure 3:
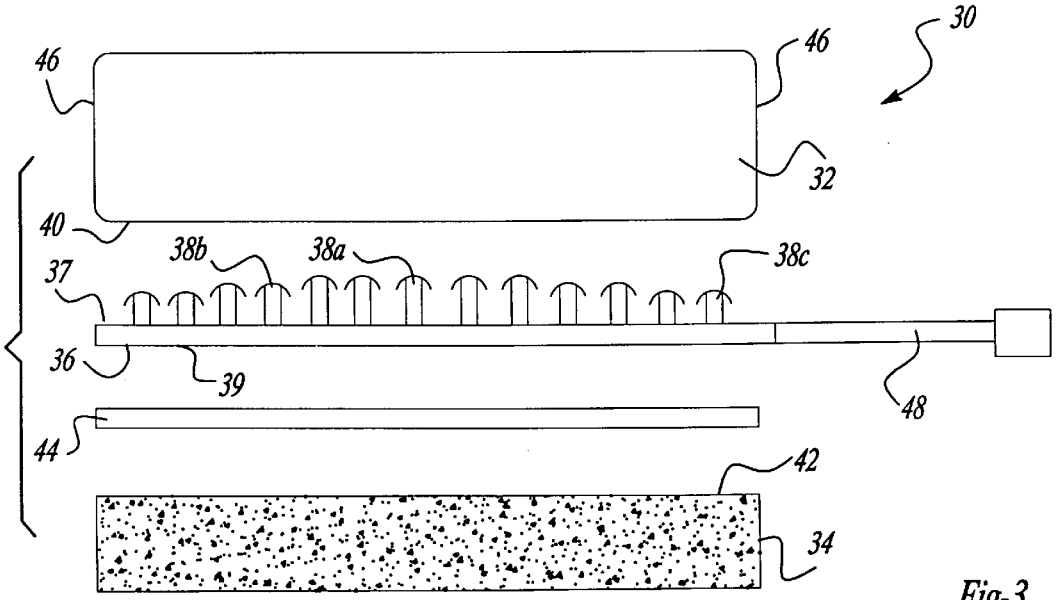
FIG. 3 is an exploded view of a bar of soap in combination with a sponge arranged in accordance with the principles of a second embodiment of the present invention.
Figure 4:
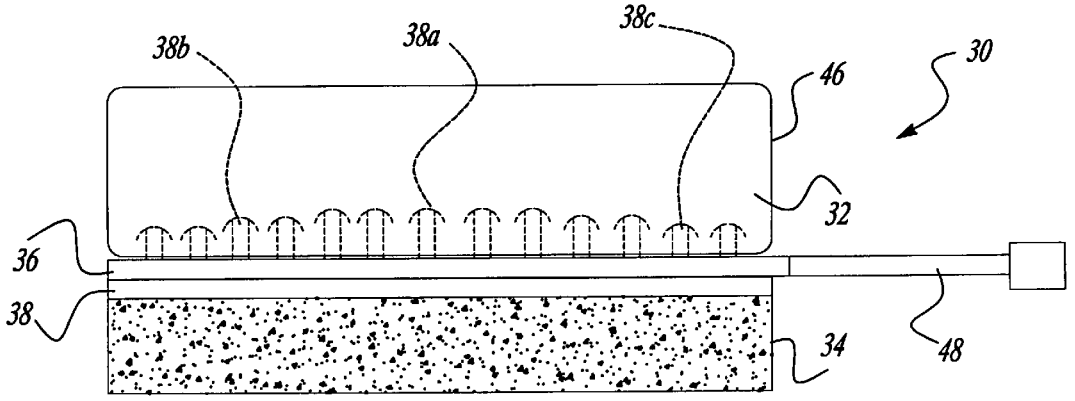
FIG. 4 is a elevational view of a bar of soap in combination with the sponge of FIG. 3 with the soap and sponge shown in close proximity.

With reference to FIGS. 3 and 4, a combination bar of soap and sponge 30 is shown as arranged in accordance with the principles of a second embodiment of the present invention. The combination bar of soap and sponge 30 includes a bar of soap 32, which is generally solid as described with respect to FIG. 1. The combination bar of soap and sponge 30 also includes a sponge 34 for attachment to bar of soap 32. Also shown in FIGS. 3 and 4 is a substrate or plate 36 having a plurality of fingers 38*a*, 38*b*, 38*c* formed on a first side 37, and also has a handle 48 to facilitate use of the combination bar of soap and sponge 30. As shown in FIG. 4, the fingers 38*a*, 38*b*, 38*c* penetrate the bar of soap 32 in order to attach bar of soap 32 on one side 40 to substrate or plate 36. Substrate or plate 36 also attaches on a second side 39 to the first side 42 of sponge 34. Sponge 34 and substrate or plate 36 interconnect by means of adhesive layer 44 interposed between substrate or plate 36 and sponge 34.

In the embodiment shown in FIGS. 3 and 4, rather than interconnection of the soap and sponge through use of an adhesive, the adhesive provides interconnection only between the sponge 34 and plate 36. Further, plate 36 attaches to bar of soap 32 by means of mechanical interaction between the fingers 38 and bar of soap 32. An additional feature of the present invention is that the fingers 38 vary in height so that the fingers are tallest towards the center of plate 36, as shown at 38*a*. Towards the edges 46 of bar of soap 32, the fingers become shorter to accommodate a typical pattern for the bar of soap 32 dissolving through use. Thus, finger 38*a* is taller than finger 38*b*, and finger 38*b* is taller than finger 38*c*.

Figure 5:
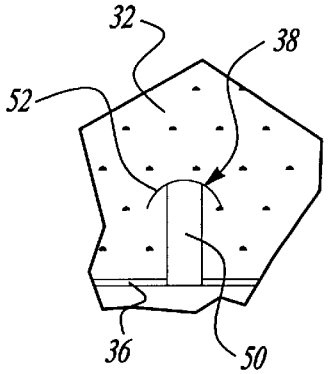
FIG. 5 is an enlarged cross-sectional view of a finger for holding the bar of soap to a supporting substrate or plate.

FIG. 5 depicts an enlarged, cross-sectional view of the interaction between a finger 38 and soap 32. In the present embodiment, finger 38 includes a support or post 50 which projects from plate 36. A cap 52 has a generally semi-spherical shape and is formed on top of post 50. During manufacture, the plate 36 and attached fingers 38 may be placed in a mold, and soap 32 in molten form is poured into the mold. Soap 32 flows around post 50 and under cap 52 so that when soap 32 solidifies, soap 32 does so around the fingers 38. This provides a means for attaching plate 36 and soap 32.

Figure 6:
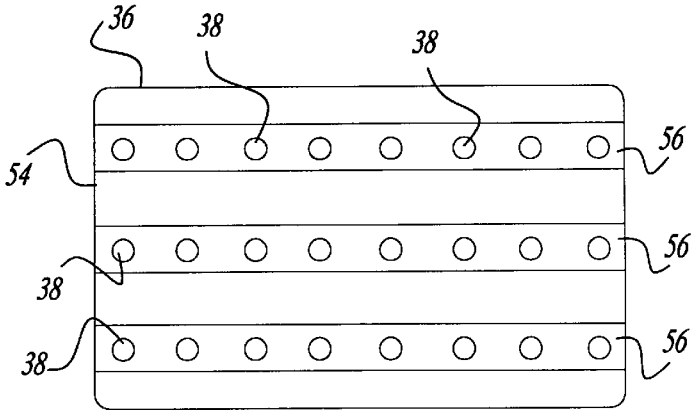
FIG. 6 is a top view of an exemplary substrate or plate.
Figure 7:
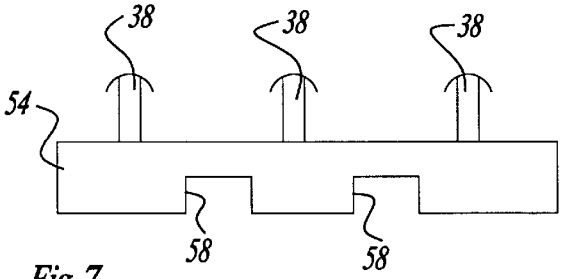
FIG. 7 is a side view of the plate of FIG. 6 showing notches to facilitated draining water away from the bar of soap.
Figure 8:
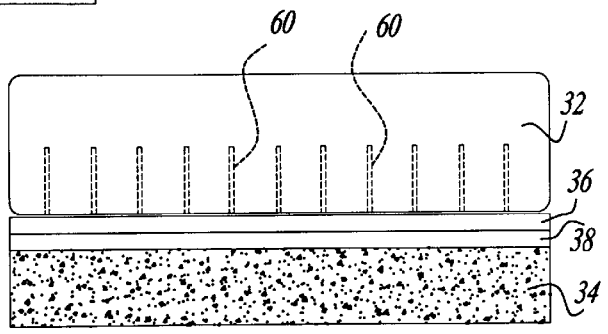
FIG. 8 is a cross-sectional view of an alternative configuration for the fingers which extend into the bar of soap.

FIG. 6 provides a top view of the plate 36 which attaches to bar of soap 32. Plate 36 may be formed of plastic, metal, or any other suitable material. In FIG. 6, the plate 36 includes a periphery 54. A plurality of runners 56 are formed across the periphery 54. The fingers 38 are formed on the runners 56. FIG. 7 shows a side view of the plate 36. In plate 36, notches 58 are formed in periphery 54 to enable water to drain from around the bar of soap, thereby preventing the bar of soap when further dissolving when not in use. One skilled in the art will recognize that an adhesive, as is shown at 44, may be substituted for fingers 38*a*, 38*b*, 38*c* on first side 37 of plate 36. Further, one skilled in the art will also recognize that the fingers projecting from plate 36 may be generally tall, narrow projections 60, rather than a post 50 and cap 52 of FIG. 5.

From the foregoing, one can recognize the advantages of the two embodiments presented herein. First, the embodiment provide a bar of soap and sponge in combination to provide a single unit which may be conveniently handled by the user. Further, the present invention provides multiple approaches for interconnecting the bar of soap and the sponge so that various applications can take advantage of a particular embodiment.

Although the invention has been described with particular reference to certain preferred embodiments thereof, variations and modifications can be effected within the spirit and scope of the following claims.

What is claimed is:

1. An apparatus, comprising:

a generally solid block of soap; and a sponge attached to the block of soap, the sponge having a first side and being attached to a first side of the block of soap to form an integral construction of the soap and sponge;

an adhesive attached to a first side of the sponge;

a plate interposed between the soap and the adhesive, the plate attaching to the soap on a first side of the plate and the adhesive on a second side of the plate to interconnect the soap and the sponge; and a plurality of posts projecting from the plate, each post having a generally semi-spherical cover formed thereon wherein the soap is poured onto the plate in a liquid state and forms in a solid state to engage the semi-spherical covers, thereby bonding the soap to the plate, and wherein posts in proximity to a center of the soap project deeper into the soap than posts spaced further away from the center of the soap.

2. The apparatus of claim 1 wherein the plate has a base which is generally flat to minimize separation between the soap and the sponge.

3. The apparatus of claim 1 wherein the plate is plastic.

4. The apparatus of claim 1 wherein the plate has channels formed on the side facing the sponge to enable drainage of liquid therethrough.

5. An apparatus comprising:

a generally solid block of soap;

a generally flat substrate attached on a first side to a first side of the block of soap; and a sponge attached on a first side to a second side of the substrate;

an adhesive layer formed between the substrate and the sponge to attach the substrate to the sponge; and a plurality of posts projecting from the substrate, each post having a generally semi-spherical cover therein, wherein the soap is poured onto the substrate in a liquid state and forms in a solid state to engage the semi-spherical covers, thereby bonding the soap to the substrate, and wherein posts in proximity to a center of the soap project deeper into the soap than posts spaced further away from the center of the soap.

6. The apparatus of claim 5 wherein the plate is plastic.

7. The apparatus of claim 5 wherein the plate has channels formed on the side facing the sponge to enable drainage of liquid therethrough.

* * * * *